US008376304B2

(12) United States Patent
Almada

(10) Patent No.: US 8,376,304 B2
(45) Date of Patent: Feb. 19, 2013

(54) BEVERAGE COASTER WITH DEVICE FOR EMPTYING ACCUMULATED LIQUID

(76) Inventor: Samuel M Almada, Chandler, AZ (US)

( * ) Notice: Subject to any disclaimer, the term of this patent is extended or adjusted under 35 U.S.C. 154(b) by 0 days.

(21) Appl. No.: 13/185,228

(22) Filed: Jul. 18, 2011

(65) Prior Publication Data

US 2013/0020456 A1 Jan. 24, 2013

(51) Int. Cl.
*A47G 29/00* (2006.01)

(52) U.S. Cl. ..... 248/346.11; 428/85; D7/624.1

(58) Field of Classification Search ..... 248/346.11; 428/85, 66.5, 213, 311.71, 325, 312.8; 215/393, 215/394; D7/624.1
See application file for complete search history.

(56) References Cited

U.S. PATENT DOCUMENTS

| | | | | |
|---|---|---|---|---|
| 508,140 | A | 11/1893 | Koch | |
| 2,113,888 | A | 4/1938 | Kaparin | |
| 2,118,326 | A | 5/1938 | Richardson, Jr. | |
| 2,496,157 | A * | 1/1950 | Gaudino | 248/346.11 |
| 2,989,205 | A * | 6/1961 | Yaws | 248/346.11 |
| 3,268,198 | A * | 8/1966 | Swett | 248/346.11 |
| 3,808,084 | A * | 4/1974 | Doty | 248/346.11 |
| 4,858,872 | A * | 8/1989 | Witt | 248/346.11 |
| 4,978,566 | A | 12/1990 | Scheurer et al. | |
| D408,227 | S | 4/1999 | Swann, Jr. | |
| 6,089,519 | A * | 7/2000 | Laybourne | 248/346.11 |
| 6,102,352 | A | 8/2000 | Kvalog | |

* cited by examiner

*Primary Examiner* — Anita M King
(74) *Attorney, Agent, or Firm* — Morgan Law offices, PLC

(57) ABSTRACT

A beverage coaster comprises a top surface structured to support a beverage container, the top surface including a plurality of drain holes; an inner chamber including a moisture absorbing layer and a plastic sheet below the moisture absorbing layer to seal the bottom of the inner chamber; and a bottom surface. The beverage coaster includes a device allowing a user to compress the moisture absorbing layer to force removal of accumulated liquid through the drain holes. In various embodiments, the top surface is graded and includes a plurality of substantially parallel grooves formed therein, each of the grooves including a plurality of the drain holes. In various embodiments, the plastic sheet comprises a substantially flat first surface and a second surface having a button thereon; and the bottom surface is structured to include an opening to accommodate the button.

17 Claims, 5 Drawing Sheets

BEVERAGE COASTER WITH DEVICE FOR EMPTYING ACCUMULATED LIQUID

FIELD OF THE INVENTION

The present invention relates to the field of beverage coasters.

BACKGROUND

A common problem that occurs when drinking a beverage is that condensed liquid forms at the bottom of the beverage container. The moisture will remain at the bottom of the beverage container, and when the container is moved and/or tilted by the user, it can cause moisture to drip on to furniture and clothing. The age-old solution is to place the drink upon a coaster. Typically, coasters are made from a moisture-absorbing material such as cork, wood, paper fiber, or cotton. However, when such material reaches its absorptive capacity, the coaster itself can become moist and stain the furniture.

To remedy this problem, the water-absorbing material can be placed atop a water-proof support. This is the approach taken in U.S. Pat. No. 2,113,888 to Kaparin and U.S. Pat. No. 2,113,888 to Richardson, for example. U.S. Pat. No. 6,102,352 to Kvalog discloses a coaster wherein the absorbent material is placed inside a body and the condensed moisture allowed to pass through. However, such coasters do not have any device for emptying the accumulated liquid.

SUMMARY OF THE INVENTION

According to a preferred embodiment of the present invention, a beverage coaster comprises a top surface structured to support a beverage container, the top surface including a plurality of drain holes; an inner chamber including a moisture absorbing layer and a plastic sheet below the moisture absorbing layer to seal the bottom of the inner chamber; and a bottom surface. The beverage coaster includes a device allowing a user to compress the moisture absorbing layer to force removal of accumulated liquid through the drain holes. In various embodiments, the top surface is graded and includes a plurality of substantially parallel grooves formed therein, each of the grooves including a plurality of the drain holes. In various embodiments, the plastic sheet comprises a substantially flat first surface and a second surface having a button thereon; and the bottom surface is structured to include an opening to accommodate the button.

These and other aspects, features, and advantages of the present invention will become apparent from the following detailed description of preferred embodiments, which is to be read in connection with the accompanying drawings.

BRIEF DESCRIPTION OF THE DRAWINGS

FIG. 4(*b*) shows a side view of an assembled beverage coaster;

DETAILED DESCRIPTION

Figure 1:
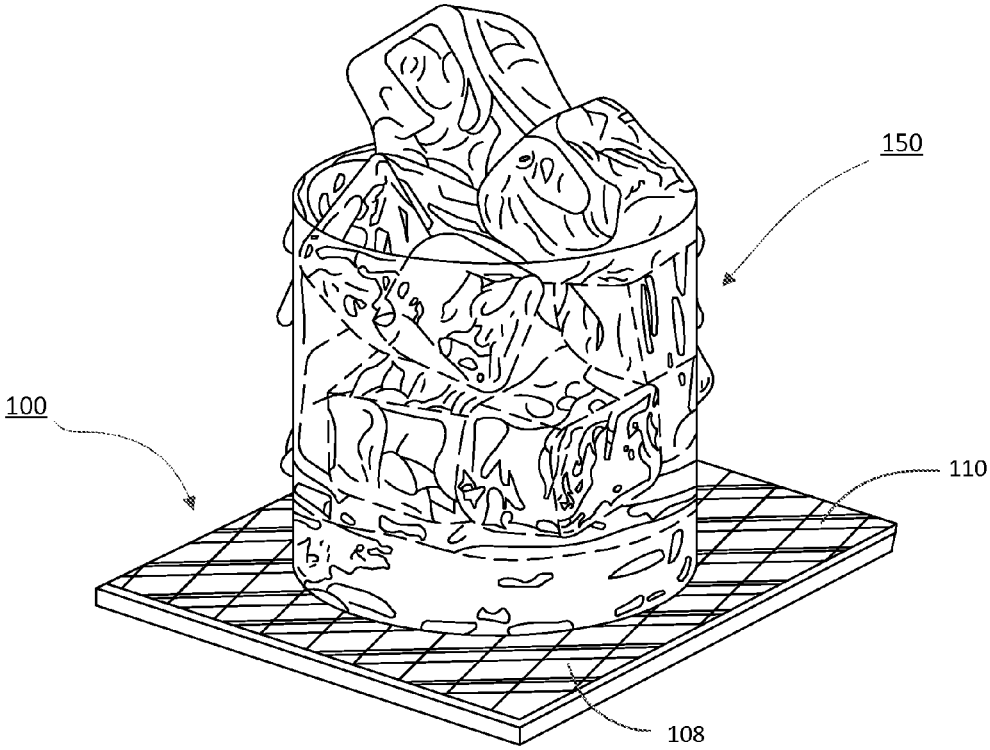
FIG. 1 shows a beverage coaster supporting a beverage container, according to an embodiment of the invention.

FIG. 1 illustrates a beverage coaster 100 supporting a beverage container 150, according to an embodiment of the invention. As shown, the beverage coaster 100 includes, on a top surface 108, a plurality of grooves 110, preferably substantially parallel to one another. The grooves 110 can include a plurality of drain holes that allow moisture from the beverage container 150 to pass through the top surface 108. In an embodiment, the grooves 110 are U-shaped grooves formed in a stainless steel sheet. In preferred embodiments, the top surface 108 is not substantially flat; instead it is graded, that is, it slants to allow liquid collecting on the top surface to flow toward the edges. In various other embodiments, the top surface 108 is made from a hard plastic material and the drain holes are molded in the plastic. In various embodiments, the top surface 108 includes patterns other than the grooved pattern shown herein. It is to be understood that the coaster design illustrated herein is meant for illustrative purposes only.

Figure 2:
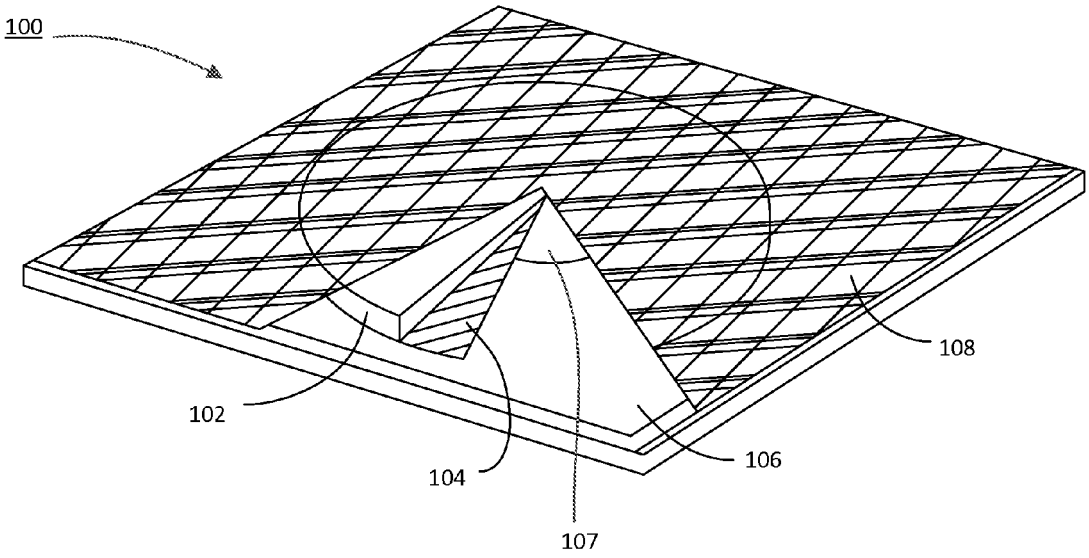
FIG. 2 shows a cutaway perspective view of the beverage coaster.
Figure 3:
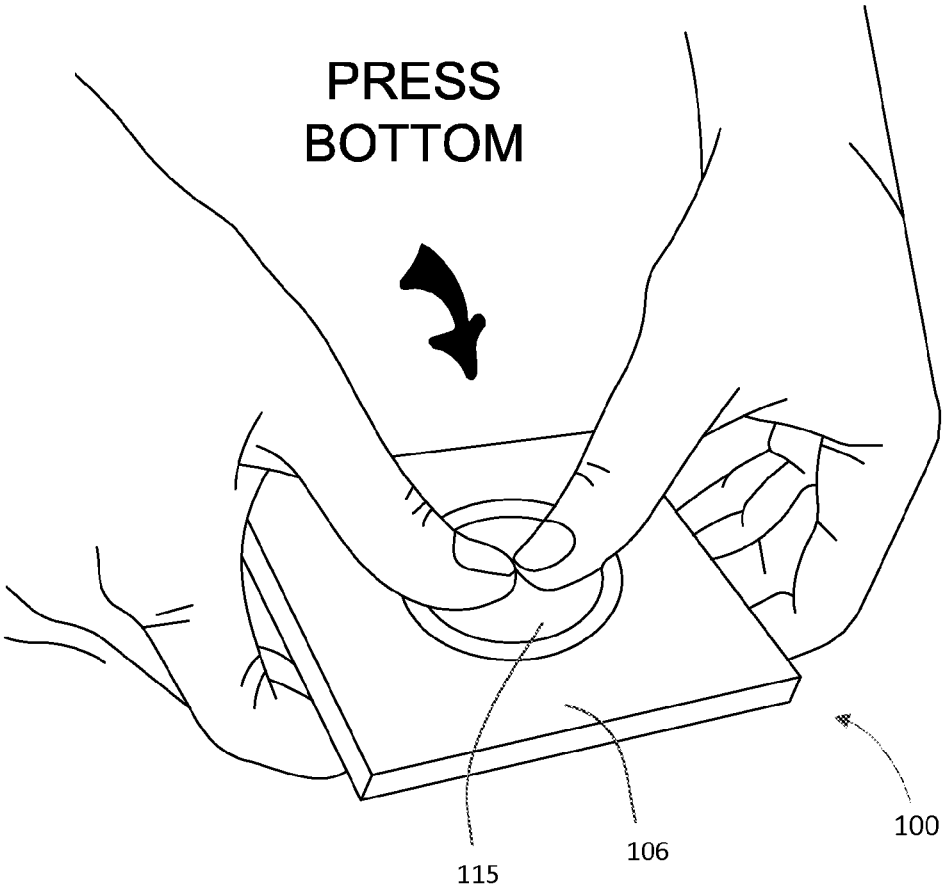
FIG. 3 shows a bottom view of the beverage coaster illustrating a user removing accumulated moisture from the inner chamber.

FIG. 2 illustrates a cutaway perspective view of the beverage coaster 100. As depicted, the beverage coaster 100 includes the top surface 108, a moisture-absorbing layer 102, a plastic sheet 104, and a bottom surface 106. Preferably, the moisture absorbing layer 102 is made from a sponge or sponge-like material. The material can comprise various sponge materials including synthetic urethane sponge, natural sponge, cellulose sponge, open cell foam, close cell foam, or other absorptive materials such as, polyvinyl alcohol (PVA), cloth (natural or synthetic), and combinations thereof. In general, the moisture-absorbing layer 102 can be made of any material or combination of materials now known or later developed suitable for water absorption and retention. As will be described in greater detail, the bottom surface 106 includes an opening 107 through which a button 115 protrudes. The button 115 can be pressed to remove accumulated moisture (as shown in FIG. 3) from the moisture-absorbing layer 102. By pressing the button, force is applied to compress the moisture-absorbing layer 102 such that liquid is removed through the drain holes in the top surface 108.

Figure 4A:
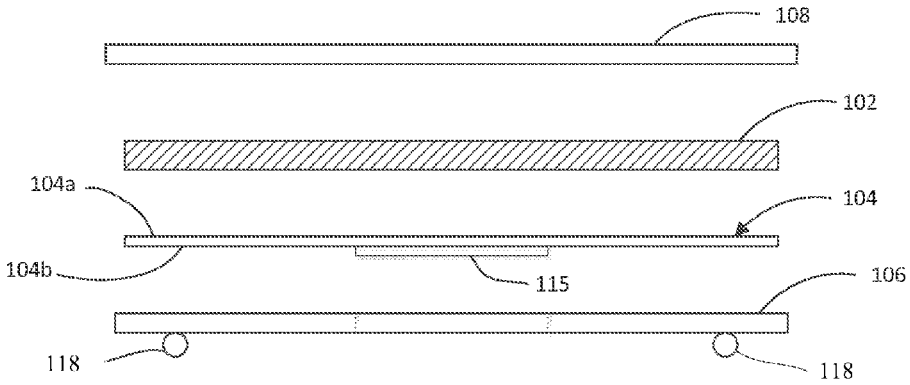
FIG. 4(*a*) shows a side, exploded view of the beverage coaster.
Figure 4B:
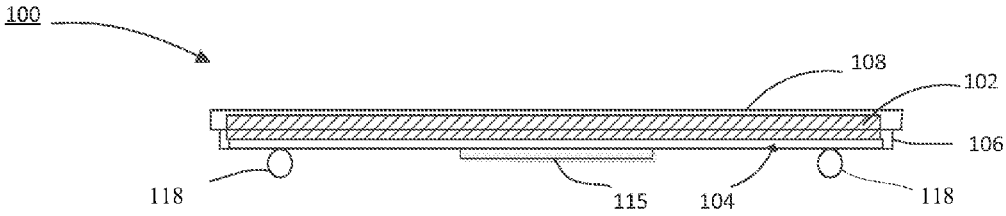

FIG. 4(*a*) illustrates a side, exploded view of the beverage coaster 100, according to a preferred embodiment. Preferably, the beverage coaster 100 includes a plurality of supports 118 to hold the device upon a surface, such as a table or desk. FIG. 4(*b*) shows a side view of an assembled beverage coaster 100.

Figure 5:
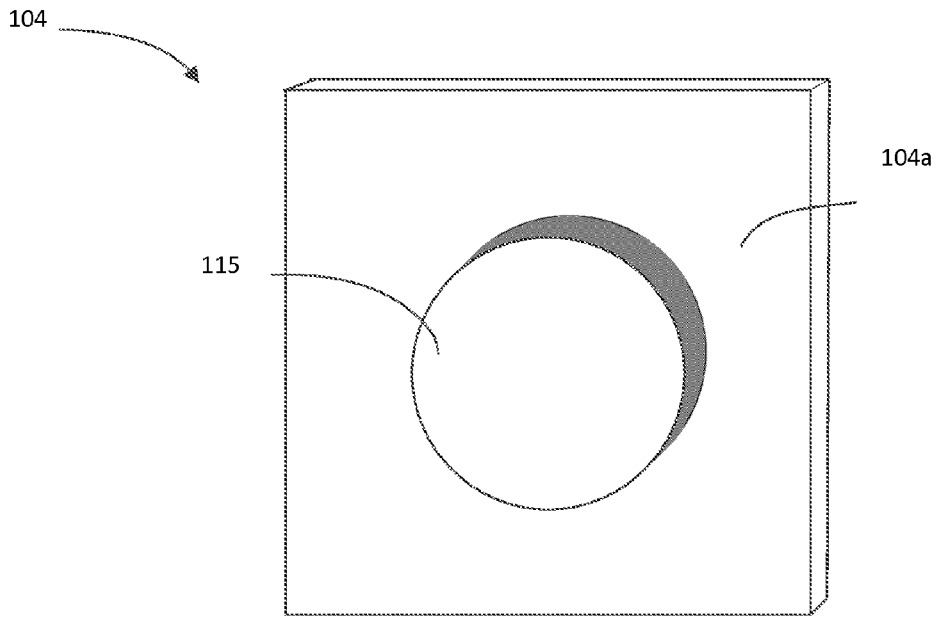
FIG. 5 shows the button which a user presses to remove accumulated liquid from the beverage coaster.
Figure 6:
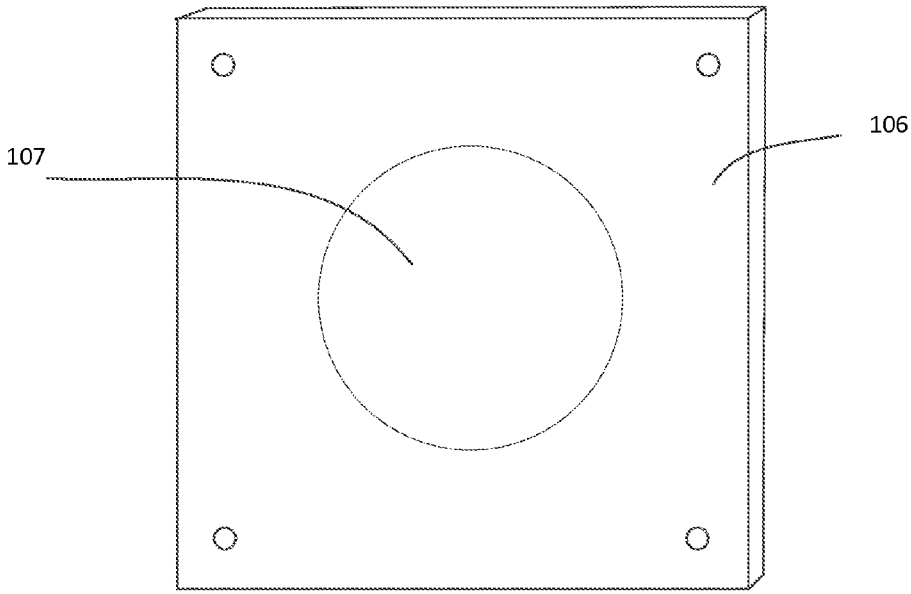
FIG. 6 shows a bottom view of the beverage coaster.

Referring to FIG. 4(*a*), the plastic sheet 104 comprises a substantially flat first surface 104*a* and a second surface 104*b* having the button 115 thereon. FIG. 5 illustrates the second surface 104*b* having the button 115. As shown in FIG. 6, the second surface 106 of the beverage coaster 100 includes the opening 107 which is sufficiently large enough to accommodate the button 115. When the user presses the button 115 the moisture-absorbing layer 102 is compressed causing accumulated fluid to be removed therefrom. Because the plastic sheet 104 blocks (seals) the bottom surface 106, any liquid forced out by the compression will flow from the drain holes in the top surface 108 following the path of least resistance.

While this invention has been described in conjunction with the various exemplary embodiments outlined above, it is evident that many alternatives, modifications and variations will be apparent to those skilled in the art. Accordingly, the exemplary embodiments of the invention, as set forth above, are intended to be illustrative, not limiting. Various changes may be made without departing from the spirit and scope of the invention.

What is claimed is:

1. A beverage coaster, comprising:

a top surface structured to support a beverage container, the top surface including a plurality of drain holes allowing moisture from the beverage container to pass through;

an inner chamber including a moisture absorbing layer for absorbing the moisture and a sheet below the moisture absorbing layer to seal the bottom of the inner chamber; and a bottom surface including a hole allowing a user to compress the moisture absorbing layer, to remove accumulated moisture through at least one of the drain holes in the top surface.

2. The beverage coaster of claim 1, wherein the sheet includes a button reachable by a user through the hole on the bottom surface.

3. The beverage coaster of claim 1, wherein the moisture absorbing layer is a sponge.

4. The beverage coaster of claim 1, wherein the top surface includes grooves that are substantially parallel to one another.

5. The beverage coaster of claim 1, wherein the top surface is graded.

6. The beverage coaster of claim 1, wherein the bottom surface includes a plurality of supports.

7. A beverage coaster, comprising:

a top surface structured to support a beverage container, the top surface graded and having a plurality of substantially parallel grooves formed therein, each of the grooves including a plurality of drain holes allowing condensation from the beverage container to pass through;

an inner chamber including a moisture absorbing layer for absorbing the condensation and a plastic sheet below the moisture absorbing layer, the plastic sheet comprising a substantially flat first surface and a second surface having a button thereon; and a bottom surface including a hole to accommodate the button and allowing a user to press the button to compress the sponge to remove fluid from the inner chamber through at least one of the holes in the top surface.

8. The beverage coaster of claim 7, wherein the top surface is constructed of stainless steel.

9. The beverage coaster of claim 7, wherein plastic sheet seals the bottom surface.

10. A beverage coaster, comprising:

a top surface structured to support a beverage container;

an inner chamber in fluid communication with the top surface; and a bottom surface having a mechanism for removing fluid from the inner chamber;

wherein the inner chamber includes a moisture absorbing layer comprising a sponge; and wherein the bottom surface includes a button protruding therefrom.

11. The beverage coaster of claim 10, wherein the top surface is graded.

12. The beverage coaster of claim 10, wherein the top surface includes a plurality of openings allowing moisture from a beverage container that is placed on the top surface to flow into the inner chamber.

13. The beverage coaster of claim 10, wherein the top surface includes a plurality of grooves.

14. The beverage coaster of claim 13, wherein each of grooves each includes a plurality of openings.

15. The beverage coaster of claim 10, wherein the inner chamber includes a plastic sheet between the moisture absorbing layer and the bottom surface.

16. The beverage coaster of claim 15, wherein the bottom surface includes a hole allowing a user to compress the sponge to remove fluid within the inner chamber.

17. The beverage coaster of claim 16, wherein the fluid is removed through the top surface.

* * * * *